US008791777B2

(12) United States Patent
Wan

(10) Patent No.: US 8,791,777 B2
(45) Date of Patent: Jul. 29, 2014

(54) ALTERNATING CURRENT CONTACTOR WITH MECHANICAL SHORT CIRCUIT SELF-LOCKING FUNCTION

(75) Inventor: Jiasheng Wan, Wuhan (CN)

(73) Assignee: Hubei Shengjia Wiring Co., Ltd, Wuhan, Hubei Province (CN)

( * ) Notice: Subject to any disclaimer, the term of this patent is extended or adjusted under 35 U.S.C. 154(b) by 0 days.

(21) Appl. No.: 13/578,406

(22) PCT Filed: Dec. 17, 2010

(86) PCT No.: PCT/CN2010/002070

§ 371 (c)(1),
(2), (4) Date: Aug. 10, 2012

(87) PCT Pub. No.: WO2011/097789

PCT Pub. Date: Aug. 18, 2011

(65) Prior Publication Data

US 2012/0307409 A1 Dec. 6, 2012

(30) Foreign Application Priority Data

Feb. 10, 2010 (CN) ..... 2010 1 0122292

(51) Int. Cl.
*H01H 77/02* (2006.01)

(52) U.S. Cl.
USPC ..... 335/34; 335/132

(58) Field of Classification Search
USPC ..... 335/34
See application file for complete search history.

(56) References Cited

U.S. PATENT DOCUMENTS

| | | | | | |
|---|---|---|---|---|---|
| 4,292,611 | A * | 9/1981 | Bresson et al. | 335/6 |
| 4,307,358 | A * | 12/1981 | Haury et al. | 335/6 |
| 4,421,959 | A * | 12/1983 | Chen et al. | 200/16 A |
| 5,163,175 | A * | 11/1992 | Mori et al. | 335/132 |
| 5,546,062 | A * | 8/1996 | Duchemin | 335/132 |
| 5,844,457 | A * | 12/1998 | Eckroth et al. | 335/132 |
| 5,986,528 | A * | 11/1999 | Meier et al. | 335/6 |
| 6,054,911 | A * | 4/2000 | Herbst et al. | 335/132 |
| 6,150,909 | A * | 11/2000 | Meier | 335/132 |
| 6,396,015 | B1 * | 5/2002 | Ko | 200/529 |
| 6,833,777 | B2 * | 12/2004 | Bollinger et al. | 335/6 |
| 6,911,884 | B2 * | 6/2005 | Uotome et al. | 335/132 |
| 7,061,352 | B2 * | 6/2006 | Lin | 335/108 |
| 2005/0162246 | A1 * | 7/2005 | Lin | 335/132 |
| 2012/0313788 | A1 * | 12/2012 | Wan | 340/650 |

* cited by examiner

*Primary Examiner* — Shawki S Ismail
*Assistant Examiner* — Lisa Homza

(57) ABSTRACT

An AC contactor with a mechanical short circuit self-locking function includes an AC contactor body. The AC contactor body includes a shell body, wherein a mechanical short circuit self-locking unit is provided therein. The mechanical short circuit self-locking unit includes a short circuit detecting and triggering device for generating a triggering action when a fault of short circuit occurs; and a self-locking acting device for generating a self-locking action after receiving the triggering action, so as to disable the AC contactor to automatically reset after the fault of short circuit is removed.

4 Claims, 10 Drawing Sheets

ALTERNATING CURRENT CONTACTOR WITH MECHANICAL SHORT CIRCUIT SELF-LOCKING FUNCTION

CROSS REFERENCE OF RELATED APPLICATION

This is a U.S. National Stage under 35 USC 371 of the International Application PCT/CN2010/002070, filed on Dec. 17, 2010.

BACKGROUND OF THE PRESENT INVENTION

1. Field of Invention

The present invention relates to an alternating current (AC) contactor with a protection function, and more particularly to an AC contactor with a mechanical short circuit self-locking function.

2. Description of Related Arts

As is known to all, in conventional controlling devices, the AC contactor is widely applied in switching and controlling power lines as an important device. Usually main contacts are used to switch the circuit and auxiliary contacts are used to execute controlling instructions. The main contacts usually include normally open contacts and the auxiliary contacts often include two pairs of normally closed and normally open contacts. A small-sized contactor is also usually used as an intermediate relay to cooperate with the main circuit.

The contacts of the AC contactors are made of silver alloy and have good conductivity and good resistance to high temperature corrosion.

In the present invention, a conventional structure able to basically accomplish functions of the AC contactor is named as an AC contactor body.

In a practical operation, when working, the AC contactor is able to accomplish opening a circuit under instructions of controlling devices; if a short circuit occurs, protecting action of a thermal relay may be untimely; thus when the contactor fails to break timely or the electrical protecting device has no self-locking protecting function against the short circuit, the AC contactor body usually would execute an instruction of the controlling device to pull in, so as to damage devices or cause fire; and also such an AC contactor body in a state of short circuit is unable to break the circuit. Based on above disadvantages, the present invention is provided after a long-time research and practice.

SUMMARY OF THE PRESENT INVENTION

An object of the present invention is to provide an AC contactor with a mechanical short circuit self-locking function to overcome above disadvantages.

In order to accomplish the above objects, the present invention provides an AC contactor with a mechanical short circuit self-locking function, comprising an AC contactor body.

The AC contactor body comprises a shell body; a mechanical short circuit self-locking unit is provided in the shell body.

The mechanical short circuit self-locking unit comprises:

a short circuit detecting and triggering device, for generating a triggering action when a fault of short circuit occurs; and a self-locking acting device which generates a self-locking action after receiving the triggering action to disable the AC contactor to automatically reset after the fault of short circuit is solved.

Preferably, the AC contactor body further comprises:

an electromagnetic moving unit; and several groups of closing and opening structures, wherein each group corresponds with a circuit line and comprises two fixed contact plates and a movable contact plate, wherein the two fixed contact plates are respectively connected to an input metal conducting plate and an output metal conducting plate;

wherein the movable contact plate corresponds with the two fixed contact plates and is connected to the electromagnetic moving unit; and in a state of being charged, the electromagnetic moving unit drives the movable contact plate and the two fixed contact plates to contact with each other to accomplish closing the correspondent circuit line.

The electromagnetic moving unit comprises an electromagnet, a reset spring, a movable iron core and a controlling switch, wherein the movable iron core is connected to the movable contact plate;

the controlling switch is a normally closed switch which forms into a closed circuit with coils of the electromagnet and phase lines; and the reset spring is for resetting the movable iron core when the electromagnet loses magnetism, so as to disconnect the movable contact plate from the two fixed contact plates.

The short circuit detecting and triggering device comprises:

a first rotating part, sleeving on a first rotating shaft, wherein the first rotating part comprises a first resisting and pushing rod and a short circuit triggering rod, wherein at least a triggering end of the short circuit trigger rod is made of permeable materials and the triggering end is provided at a lower end of the input metal conducting plate or the output metal conducting plate of the AC contactor body; and a first resetting part, connected to the first rotating part for resetting the first rotating part.

The self-locking acting device comprises:

a self-locking resetting part, correspondent with a hole on an upper cover on the shell body, wherein a top end of the self-locking resetting part extends through the hole when short circuit occurs;

a second rotating part sleeved on a second rotating shaft, wherein the second rotating part comprises a second resisting and pushing rod, a third resisting and pushing rod and a self-locking resisting and pressing rod, wherein the second resisting and pushing rod resists and supports the first resisting and pushing rod;

the third resisting and pushing rod and the self-locking resetting part form a limiting connection; and the self-locking resisting and pressing rod corresponds with the controlling switch and accomplishes pressing the controlling switch via rotation of the second rotating part; and a second resetting part, connected to the second rotating part for resetting the second rotating part.

The self-locking resetting part comprises:

a frame body having a concave cavity, wherein the concave cavity and a hooking end of the third resisting and pushing rod forms a hanging connection; and a third resetting part connected to the frame body for resetting the frame body.

Preferably, the first resetting part, the second resetting part and the third resetting part are resetting springs.

Compared with conventional arts, the present invention is able to generate self-locking actions when short circuit occurs and thus allow unlocking only via manual operations, so as to realize safety in using electricity and indicate the short circuit fault.

These and other objectives, features, and advantages of the present invention will become apparent from the following detailed description, the accompanying drawings, and the appended claims.

DETAILED DESCRIPTION OF THE PREFERRED EMBODIMENT

Combined with the drawings, detailed illustrations about above and extra technical features and advantages of the present invention are following.

Figure 1A:
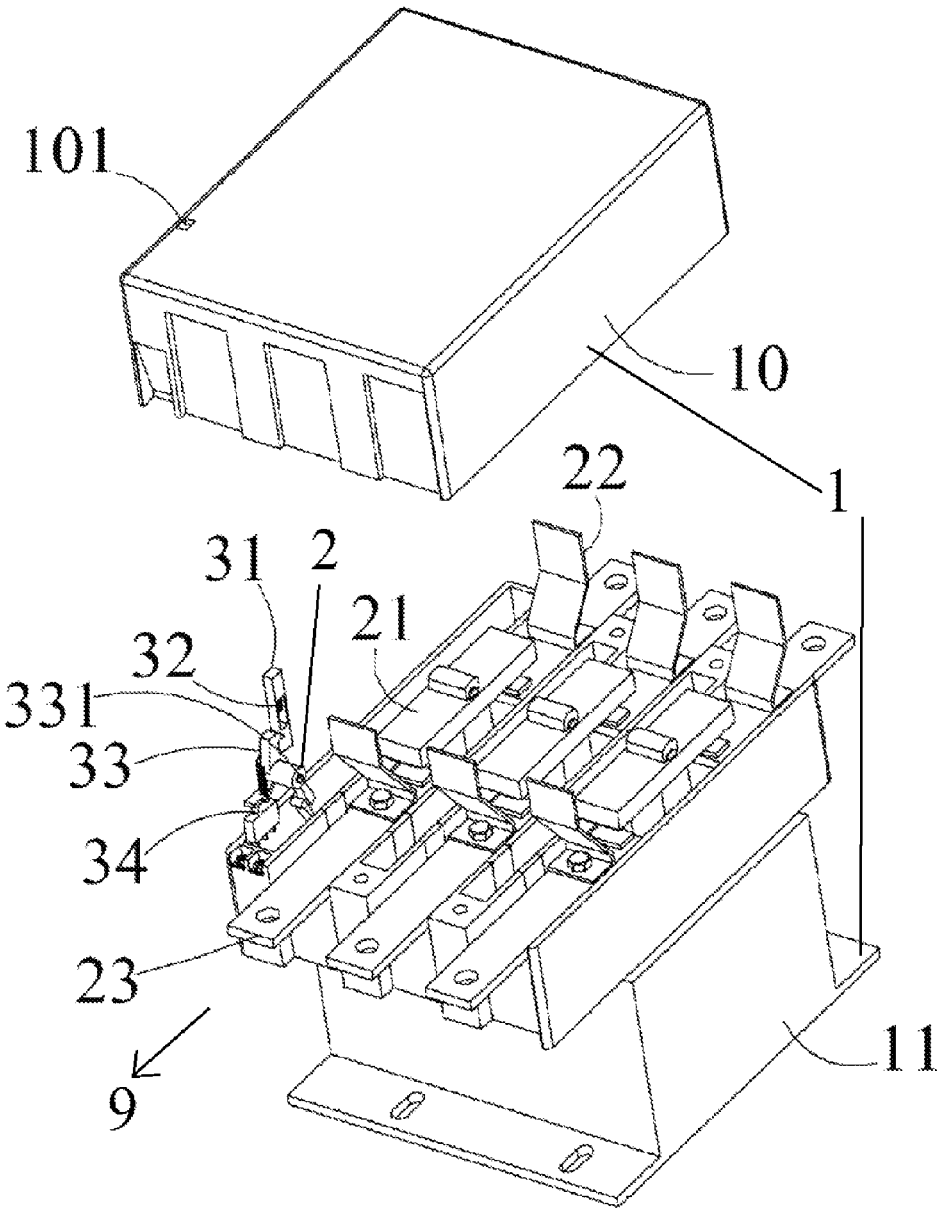
FIG. 1A is a perspective view of an AC contactor with a mechanical short circuit self-locking function whose upper cover is opened according to a first preferred embodiment of the present invention.
Figure 1B:
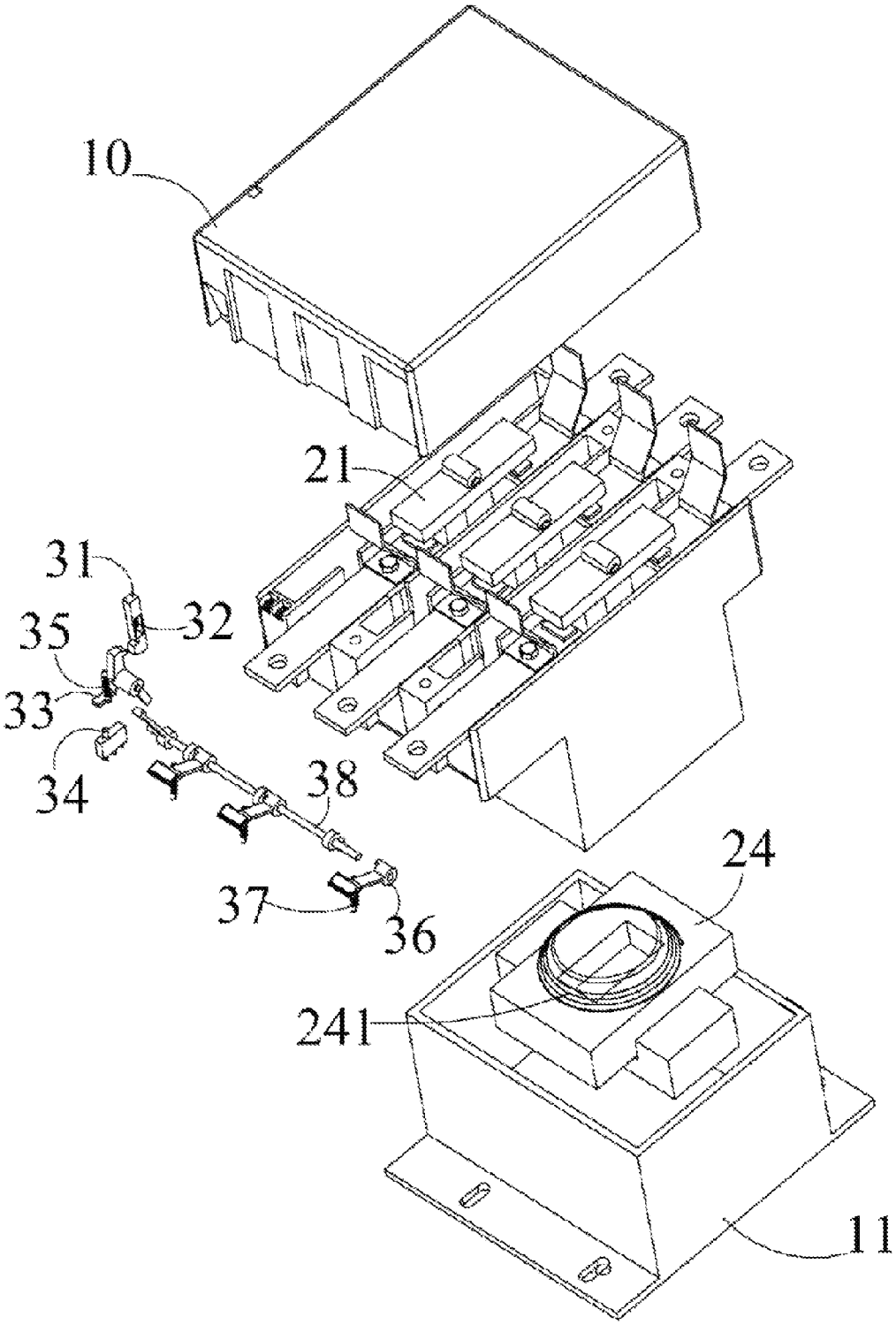
FIG. 1B is a perspective view of main breakdown structures of the AC contactor according to the first preferred embodiment of the present invention.

Referring to FIGS. 1A and 1B of the drawings, according to a first preferred embodiment of the present invention, an AC contactor with a mechanical short circuit self-locking function whose upper cover is opened and main breakdown structures thereof are respectively illustrated. The AC contactor comprises an AC contactor body 9. The AC contactor body 9 comprises a shell body 1, wherein a mechanical short circuit self-locking unit 2 is provided therein; the AC contactor body 9 can be a structure for accomplishing basic functions of opening and closing of an AC contactor.

Figure 3A:
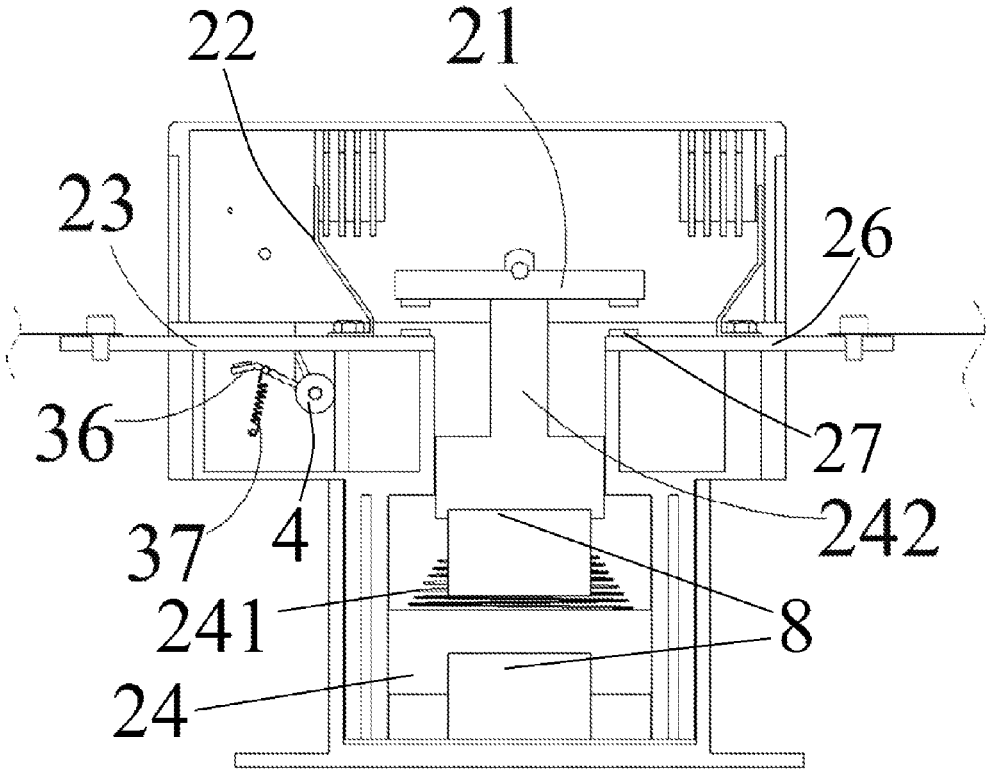
FIG. 3A is a sectional view of a short circuit detecting and triggering device in an idle state when the AC contactor is disconnected according to preferred embodiments of the present invention.

An essence of the present invention is to meet current safety standards by improving conventional AC contactors. The shell body 1 comprises an upper cover 10 and a base seat 11, wherein followings are provided in the shell body 1:

an electromagnetic moving unit 8 for generating electromagnetic actions in a state of being electrified, comprising an electromagnet 24, a resetting spring 241, a movable iron core 242 as showed in FIG. 3A and a controlling switch 34, wherein the movable iron core 242 is connected to a movable contact plate 21; the controlling switch 34 is a normally closed switch and is electrically connected to the electromagnet 24, in such a manner that the electromagnet 24 is able to attract the movable iron core 242 down to set the resetting spring 241 in a state of compression as long as currents flow through a circuit where the AC contactor body 9 is located; and the resetting spring 241 is able to reset the movable iron core 242 upwardly when the electromagnet 24 loses magnetism; and several groups of closing and opening structures 7, wherein each group 7 corresponds with a circuit line (phase line) and comprises two fixed contact plates 27 and a movable contact plate 21, wherein the two fixed contact plates 27 are respectively connected to an input metal conducting plate 23 and an output metal conducting plate 26 provided at opposite sides; the input metal conducting plate 23 and the output metal conducting plate 26 are respectively connected to the phase lines; and an arc suppression cover 22 is further provided to protect elements or contacts on the circuit line from being damaged by sparks generated by opening or closing.

The movable contact plate 21 corresponds with the two fixed contact plates 27 and is connected to the movable iron core 242 in the electromagnetic moving unit 8; when being energized with currents, the movable iron core 242 drives the movable contact plate 21 to touch the two fixed contact plates 27 to accomplish closing the located circuit.

The mechanical short circuit self-locking unit 2 comprises a short circuit detecting and triggering unit 4 and a self-locking acting device 3, wherein the short circuit detecting and triggering unit 4 generates a triggering action when a short circuit occurs; and the short circuit is detected via strong magnetic fields generated by the short circuit. The short circuit detecting and triggering device 4 comprises:

a first rotating part 36 sleeved on a first rotating shaft 38 which is provided on the upper cover 10 and the base seat 11, wherein the first rotating part 36 comprises a first resisting and pushing rod 362 and a short circuit triggering rod 361, wherein at least a triggering end 3611 of the short circuit triggering rod 361 is made of magnetic permeable material and the triggering end 3611 is provided below the input metal conducting plate 23 and the output metal conducting plate 26, as showed in FIG. 3A to 3E; and a first resetting part 37 connected to the first rotating part 36 for resetting the first rotating part 36, wherein the first resetting part 37 can be a resetting spring or an elastic metal plate; a first end thereof is connected to the short circuit triggering rod 361 on the first rotating part 36; a second end thereof hangs on the shell body 1 of the AC contactor body 9.

The self-locking acting device 3 links and generates a self-locking action because of the triggering action, so as to disable the AC contactor body 9 to automatically reset after a fault of short circuit is removed. The self-locking acting device 3 comprises:

a self-locking resetting part 30, correspondent with a hole 101 provided on an upper part of the upper cover 10 on the shell body 1, wherein a top end thereof extends through the hole 101 when a short circuit occurs, and comprising:

a frame body 31 having a concave cavity 312; and a third resetting part 32 connected to the frame body 31 for resetting the frame body 31, wherein, according to a preferred embodiment of the present invention, the frame body 31 has a holding hole 313 and the third resetting part 32 is provided therein; a positioning board 311 is also provided therein; and a first end of the third resetting part 32 resists the positioning board 311 and a second end of the third resetting part 32 resists and leans against an upper end of the holding hole 313 of the frame body 31;

a second rotating part 33 sleeved on a second rotating shaft 331, comprising a second resisting and pushing rod 332, a third resisting and pushing rod 333 and a self-locking resisting and pressing rod 334, wherein the second resisting and pushing rod 332 and the first resisting and pushing rod 362 are mutually resisted; a hooking end 3331 of the third resisting and pushing rod 333 and the concave cavity 312 on the frame body 31 form a hanging connection, so as to limit the self-locking resetting part 30; the self-locking resisting and pressing rod 334 corresponds with the controlling switch 34 and presses the controlling switch 34 via rotation of the second rotating part 33, in such a manner that the controlling switch 34 turns into an open state from a state of being normally closed; and two second resetting parts 35 and 39, respectively connected to the second rotating part 33 for resetting the second rotating part 33, wherein the second resetting parts 35 and 39 and the third resetting part 32 can be resetting springs or elastic metal plates; and a first end thereof is connected to the self-locking resisting and pressing rod 334 of the second rotating part 33 and a second end thereof hangs on the shell body 1 of the AC contactor body 9.

Figure 2A:
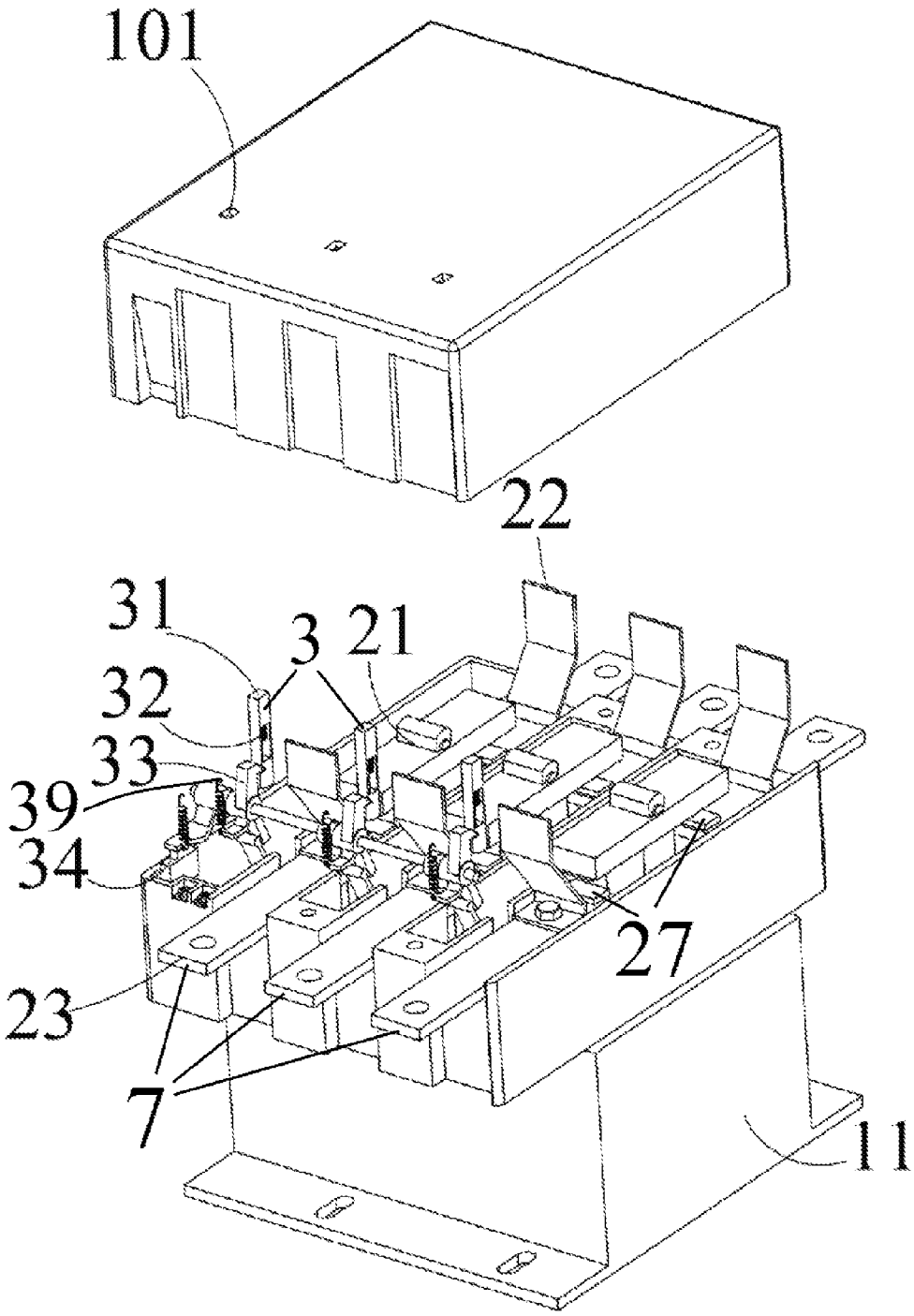
FIG. 2A is a perspective view of the AC contactor whose upper cover is opened according to a second preferred embodiment of the present invention.
Figure 2B:
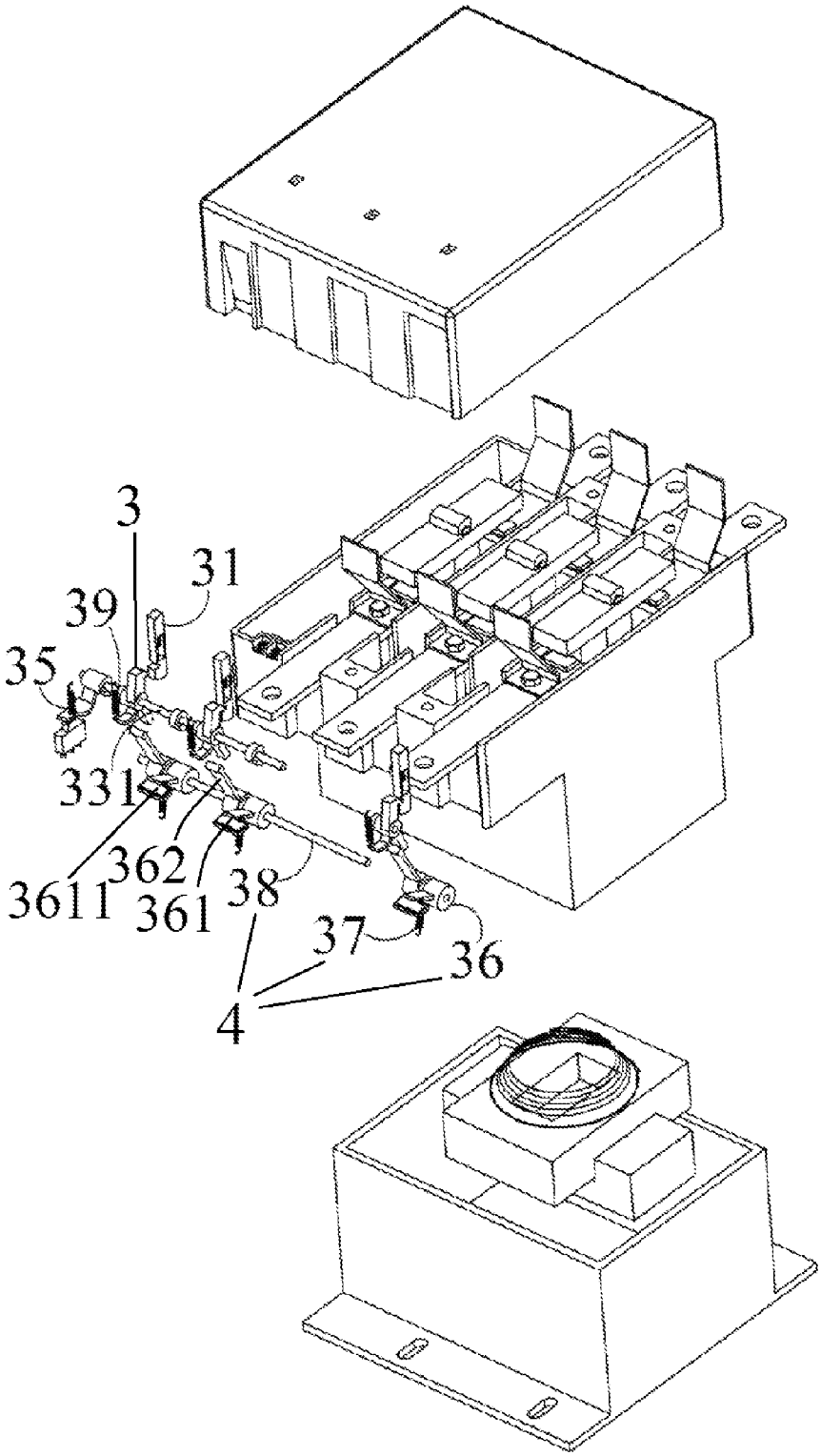
FIG. 2B is a perspective view of the main breakdown structures of the AC contactor according to the second preferred embodiment of the present invention.

Referring to FIGS. 2A and 2B, the AC contactor whose upper cover 10 is opened and the main breakdown structures thereof are illustrated. Different from the first embodiment of the present invention, each group of closing and opening structures 7 is provided with a self-locking acting device 3, and thus three groups of self-locking acting device are showed, i.e., three second rotating parts 33 and three correspondent self-locking resetting parts 39 are provided on the second rotating shaft 331. Thus when a short circuit occurs, three frame bodies 31 extend through the hole 101 on the upper part of the upper cover 10.

Referring to FIG. 3A to 3E, working principles and a working process of the AC contactor are following.

Figure 3B:
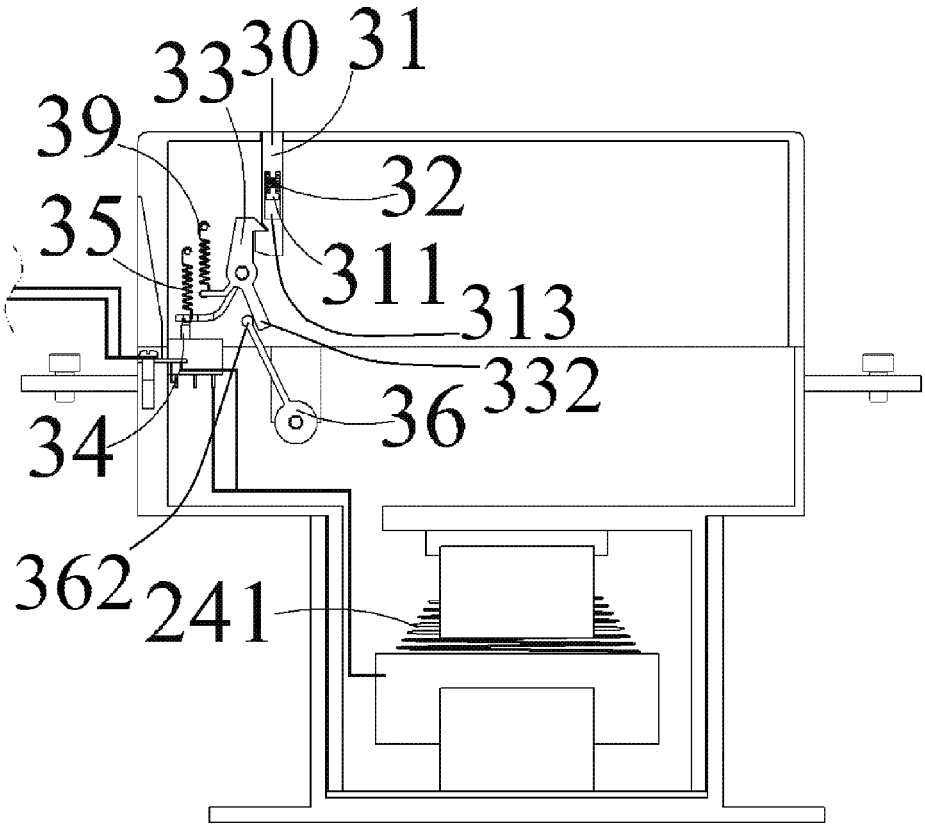
FIG. 3B is a sectional view of a self-locking acting device in an idle state when the AC contactor is disconnected according to the preferred embodiments of the present invention.
Figure 3C:
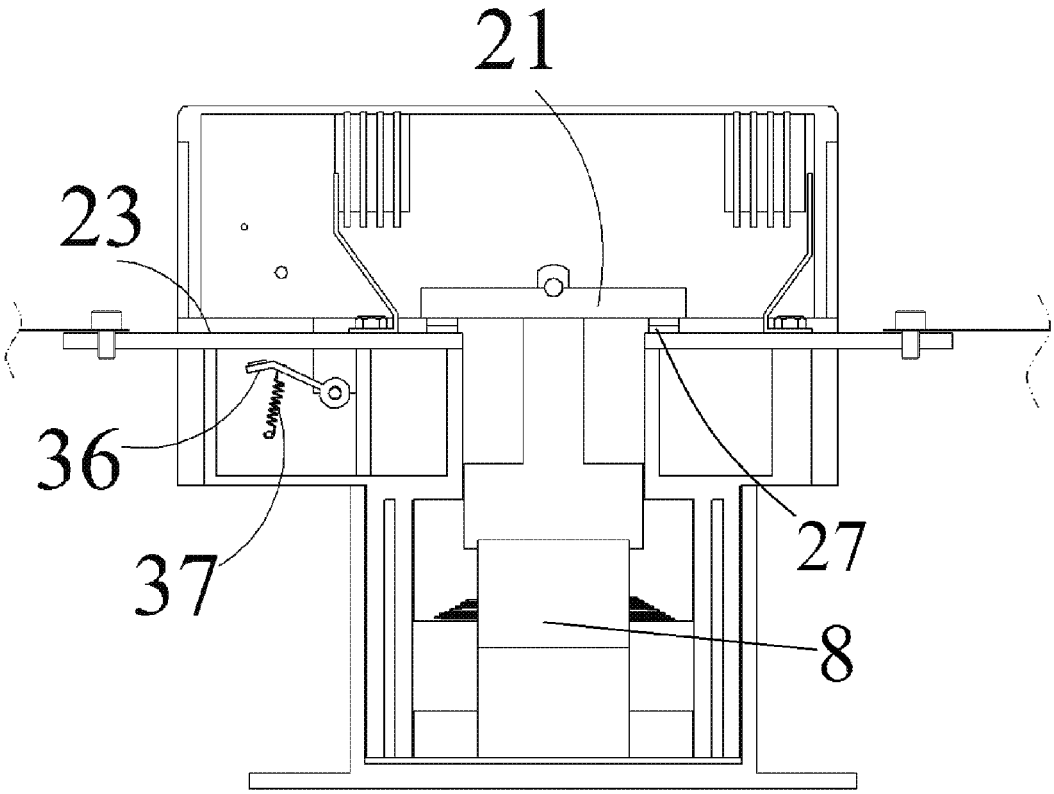
FIG. 3C is a sectional view of the short circuit detecting and triggering device in an idle state when the AC contactor is connected according to the preferred embodiments of the present invention.

FIGS. 3A, 3B and 3C respectively show sectional views of the short circuit detecting and triggering device 4 in an idle state when the AC contactor is disconnected, the self-locking acting device 3 in an idle state when the AC contactor is disconnected, and the short circuit detecting and triggering device 4 in an idle state when the AC contactor is connected, wherein the first resetting part 37 hangs on the short circuit triggering rod 361 of the first rotating part 36; the self-locking resisting and pressing rod 334 of the second rotating part 33 formed by subcomponents generates no pressing actions on the controlling switch 34; and the first resisting and pushing rod 362 applies no driving force on the second resisting and pushing rod 332, when the AC contactor body 9 is in a normal state of working.

Figure 3D:
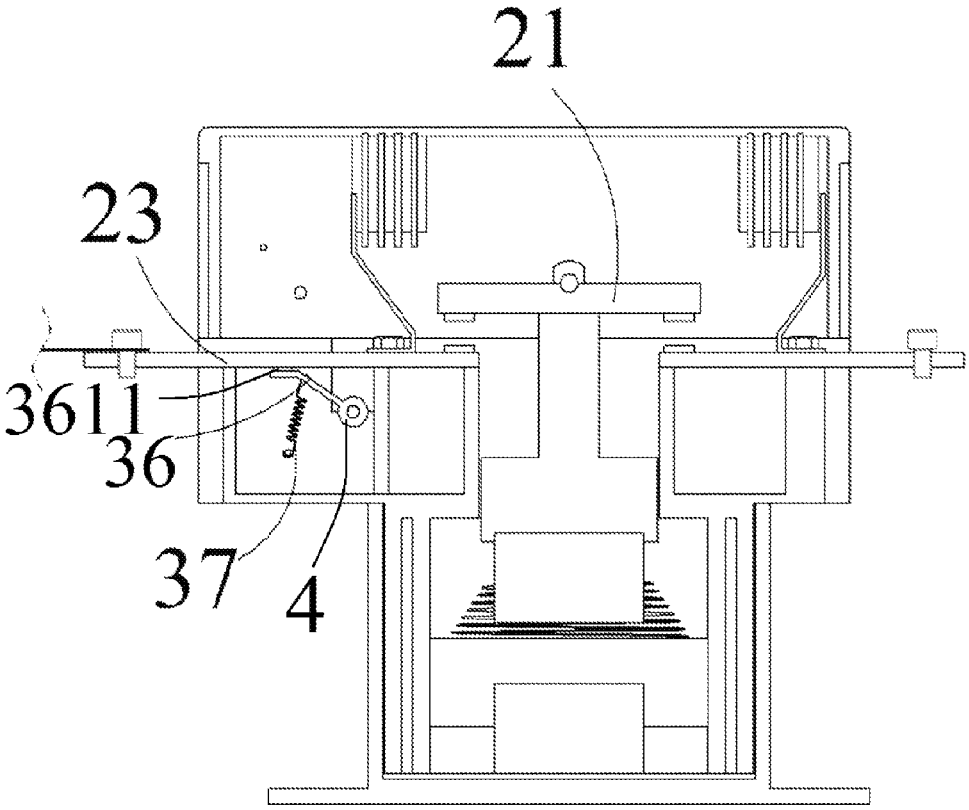
FIG. 3D is a sectional view of the short circuit detecting and triggering device in a working state when a short circuit of the AC contactor occurs according to the preferred embodiments of the present invention.
Figure 3E:
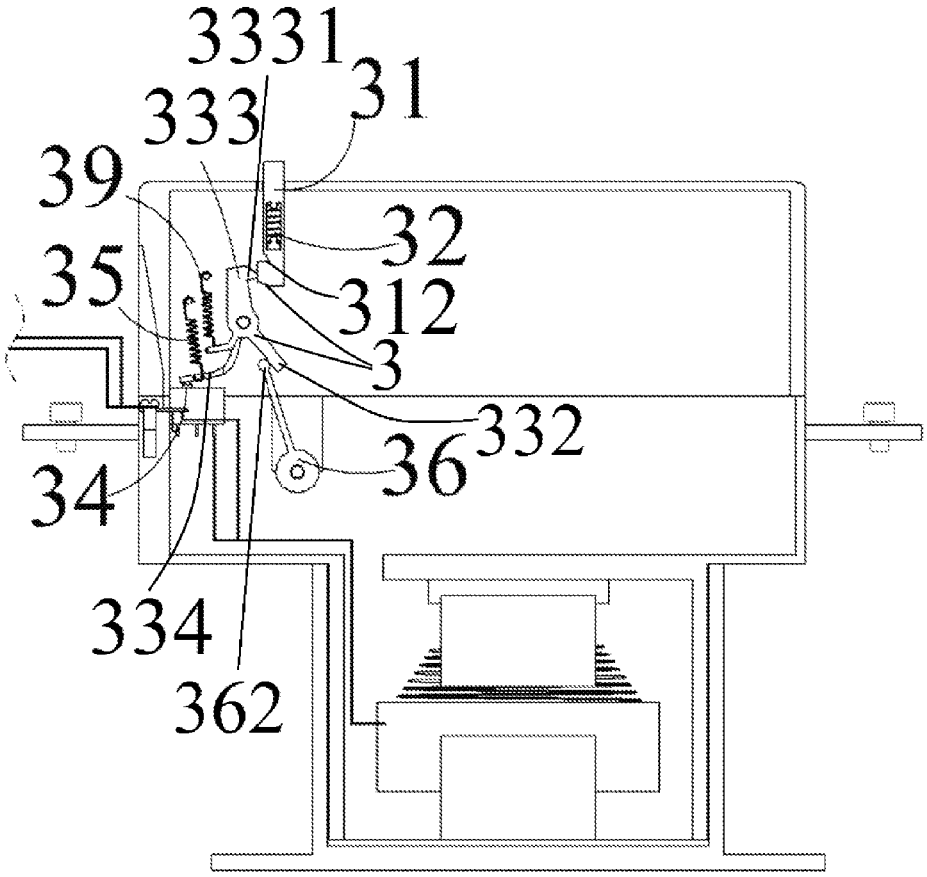
FIG. 3E is a sectional view of the self-locking acting device in an acting state when the short circuit of the AC contactor occurs according to the preferred embodiments of the present invention.

FIGS. 3D and 3E respectively show sectional views of the short circuit detecting and triggering device 4 in a working state and the self-locking acting device 3 in an acting state when a short circuit of the AC contactor occurs. Because the short circuit occurs, strong magnetic fields are generated around the input metal conducting plate 23; thus the triggering end 3611 of the short circuit triggering rod 361 of the first rotating part 36 is attracted to drive the first rotating part 36 to rotate and the first resisting and pushing rod 362 drives the second resisting and pushing rod 332, so as to force the second rotating part 33 to rotate, in such a manner that the self-locking resisting and pressing rod 334 of the second rotating part 33 presses the controlling switch 34 and meanwhile the hooking end 3331 of the third resisting and pushing rod 333 detaches from the concave cavity 312 on the frame body 31; and thus under actions of the third resetting part 32, the frame body 31 of the self-locking resetting part 30 is pushed out of the hole 101 on the shell body 1.

Figure 4:
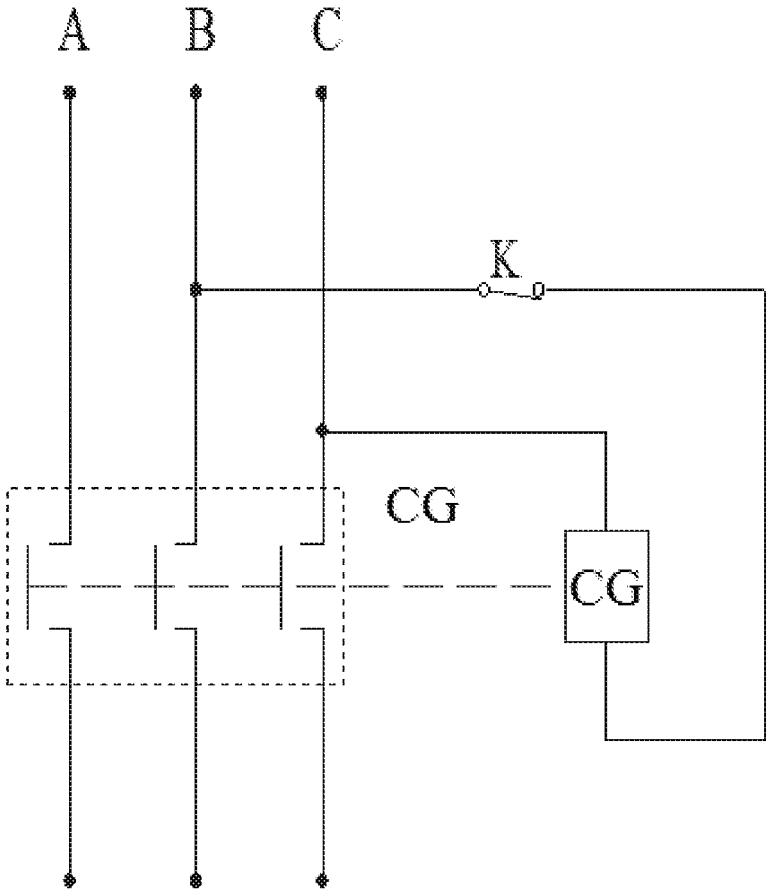
FIG. 4 is a sketch view of a circuit structure of the AC contactor according to the preferred embodiments of the present invention.

FIG. 4 shows a sketch view of a circuit structure of the AC contactor. Since the controlling switch 34 is pressed down, K is opened and the electromagnet CG has no currents; under actions of the resetting spring 241, the movable iron core 242 drives the movable contact plate 21 to detach from the fixed contact plates 27, and thus the fault of the short circuit is removed and accordingly the strong magnetic fields disappear, which results in that the short circuit triggering rod 361 of the first rotating part 36 is driven by the first resetting part 37 to rotate; the second rotating part 33 is driven by the second resetting part 35 to have a tendency to rotate, but meanwhile a lower end of the frame body 31 of the self-locking resetting part 30 resists and leans against the hooking end 3331 of the third resisting and pushing rod 333, which disables the second rotating part 33 to rotate; and thus the self-locking resisting and pressing rod 334 of the second rotating part 33 still presses the controlling switch 34, in such a manner that the AC contactor body 9 fails to be reset.

In such a situation, only by manually pressing back the frame body 31 of the self-locking resetting part 30 which extends out of the hole 101 on the shell body 1, the second rotating part 33 can rotate; the hooking end 3331 of the third resisting and pushing rod 333 can recover being hung within the concave cavity on the frame body 31, so as to free the controlling switch 34 from being pressed by the self-locking resisting and pressing rod 334 of the second rotating part 33 to further accomplish resetting the AC contactor body 9.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An AC contactor with a mechanical short circuit self-locking function, comprising an AC contactor body which comprises:

a shell body;

a mechanical short circuit self-locking unit provided in said shell body, wherein said mechanical short circuit self-locking unit comprises a short circuit detecting and triggering device for generating a triggering action when a fault of short circuit occurs, and a self-locking acting device for generating a self-locking action after receiving said triggering action to disable said AC contactor to automatically reset after the fault of short circuit is removed;

an electromagnetic moving unit, comprising an electromagnet, a resetting spring, a movable iron core and a controlling switch, wherein said movable iron core is connected to a movable contact plate; said controlling switch is a normally closed switch, wherein said controlling switch is electrically connected to said electromagnet; and said resetting spring is for resetting said movable iron core when said electromagnet loses magnetism, so as to detach said movable contact plate from two fixed contact plates; and several groups of closing and opening structures, wherein each group corresponds with a circuit line and comprises:

the two fixed contact plates and the movable contact plate, wherein an input metal conducting plate and an output metal conducting plate are respectively connected to said two fixed contact plates, wherein said movable contact plate corresponds with said two fixed contact plates and is connected to said electromagnetic moving unit; and in a state of being energized, said electromagnetic moving unit drives said movable contact plate to touch said two fixed contact plates, so as to close a circuit line where said movable contact plate and said two fixed contact plates are located;

wherein said short circuit detecting and triggering device comprises:

a first rotating part sleeved on a first rotating shaft, wherein said first rotating part comprises a first resisting and pushing rod and a short circuit triggering rod, wherein at least a triggering end of said short circuit triggering rod is made of permeable materials and said triggering end thereof is provided at a lower end of said input metal conducting plate or said output metal conducting plate; and a first resetting part connected to said first rotating part for resetting said first rotating part.

2. The AC contactor, as recited in claim 1, wherein said self-locking acting device comprises:

a self-locking resetting part correspondent with a hole of an upper part of an upper cover of said shell body, wherein said self-locking resetting part extends through said hole when a short circuit occurs;

a second rotating part sleeved on a second rotating shaft, comprising a second resisting and pushing rod, a third resisting and pushing rod and a self-locking resisting and pressing rod, wherein said second resisting and pushing rod and said first resisting and pushing rod are mutually resisted and supported; said third resisting and pushing rod and said self-locking resetting part form a limiting connection; and said self-locking resisting and pressing rod corresponds with said controlling switch and presses said controlling switch via rotation of said second rotating part; and a second resetting part connected to said second rotating part for resetting said second rotating part.

3. The AC contactor, as recited in claim 2, wherein said self-locking resetting part comprises:

a frame body, wherein said frame body has a concave cavity; said concave cavity and a hooking end of said third resisting and pushing rod form a hanging connection; and a third resetting part connected to said frame body for resetting said frame body.

4. The AC contactor, as recited in claim 3, wherein said first resetting part, said second resetting part and said third resetting part are all resetting springs.

* * * * *